US012653249B2

(12) United States Patent
Todaro et al.

(10) Patent No.: US 12,653,249 B2
(45) **Date of Patent: *Jun. 16, 2026**

(54) BRASSIERE

(71) Applicant: Mast Industries (Far East) Limited, Kowloon Bay (HK)

(72) Inventors: Ursula Giovanna Todaro, Commack, NY (US); Nathalie Martinet, Saikung (HK); Jennifer Ostroski, Red Bank, NJ (US)

(73) Assignee: Mast Industries (Far East) Limited, Kowloon Bay (HK)

( * ) Notice: Subject to any disclaimer, the term of this patent is extended or adjusted under 35 U.S.C. 154(b) by 0 days.

This patent is subject to a terminal disclaimer.

(21) Appl. No.: 18/975,838

(22) Filed: Dec. 10, 2024

(65) Prior Publication Data

US 2025/0098794 A1 Mar. 27, 2025

Related U.S. Application Data

(63) Continuation of application No. 17/588,387, filed on Jan. 31, 2022.

(Continued)

(51) Int. Cl.

| | |
|---|---|
| ***A41C 3/00*** | (2006.01) |
| ***A41C 3/10*** | (2006.01) |
| ***A41C 3/14*** | (2006.01) |

(52) U.S. Cl.

CPC ..... *A41C 3/0014* (2013.01); *A41C 3/10* (2013.01); *A41C 3/144* (2013.01)

(58) Field of Classification Search

None

See application file for complete search history.

(56) References Cited

U.S. PATENT DOCUMENTS 2,332,141 A * 10/1943 Greene ..... A41C 1/00 450/98
2,440,466 A * 4/1948 Freedman ..... A41C 3/10 450/55

(Continued)

FOREIGN PATENT DOCUMENTS

CN 201054982 Y 5/2008
CN 107373790 A 11/2017

(Continued)

OTHER PUBLICATIONS

European Search Report in corresponding EP Application No. 22155390.2, dated Jul. 27, 2022, 7 pages.

(Continued)

*Primary Examiner* — Gloria M Hale

(74) *Attorney, Agent, or Firm* — Andrus Intellectual Property Law, LLP

(57) ABSTRACT

A brassiere has a chest band, a portion of which includes a pair of concavities, each of which is to be located below one of a wearer's breasts. A pair of curved support members is attached to the chest band along the pair of concavities, respectively. A breast cup is situated within each concavity. Each breast cup has an inner liner, an outer liner, and a foam pad sandwiched between the inner and outer liners. The inner and/or outer liner of each breast cup is attached to the chest band along the respective concavity. The foam pad of each breast cup is not attached to the chest band, other than by way of the inner and/or outer liner. The chest band has an inner layer touching a wearer's skin, an outer layer facing outwardly from the wearer, and an intermediate layer sandwiched between the inner and outer layers.

19 Claims, 7 Drawing Sheets

Related U.S. Application Data

(60) Provisional application No. 63/147,462, filed on Feb. 9, 2021.

(56) References Cited

U.S. PATENT DOCUMENTS

| | | | | |
|---|---|---|---|---|
| 2,620,484 | A * | 12/1952 | Gerry | A41D 27/26 2/268 |
| 4,617,934 | A | 10/1986 | Hittel | |
| 5,189,738 | A * | 3/1993 | Mitchell | A41D 27/26 2/268 |
| 5,447,462 | A | 9/1995 | Smith | |
| 5,983,394 | A | 11/1999 | Joo | |
| 6,090,234 | A | 7/2000 | Barone | |
| 6,406,351 | B1 * | 6/2002 | Chen | A41C 3/142 450/55 |
| 6,811,464 | B2 * | 11/2004 | Li | A41C 5/005 450/39 |
| 7,204,741 | B2 * | 4/2007 | Giese | A41C 3/12 450/75 |
| 7,427,226 | B1 | 9/2008 | Deal | |
| 7,442,110 | B2 | 10/2008 | Gaudet | |
| 8,128,457 | B2 | 3/2012 | Reinisch | |
| 9,254,009 | B2 | 2/2016 | Abbott | |
| 9,480,287 | B2 | 11/2016 | Black | |
| 10,477,902 | B1 | 11/2019 | Blecha | |
| 10,849,368 | B2 | 12/2020 | Liu | |
| 11,172,711 | B2 | 11/2021 | Randall | |
| 12,070,085 | B2 | 8/2024 | Liu | |
| 2005/0233677 | A1 | 10/2005 | Giese | |
| 2007/0026767 | A1 | 2/2007 | Scheininger | |
| 2008/0090491 | A1 * | 4/2008 | Liu | A41C 3/122 450/39 |
| 2014/0099864 | A1 | 4/2014 | Moulden | |
| 2019/0297956 | A1 * | 10/2019 | Diaz | D04B 1/246 |
| 2020/0397064 | A1 | 12/2020 | Liu | |
| 2022/0007748 | A1 | 1/2022 | Mastrella | |
| 2022/0155761 | A1 | 5/2022 | Oriol | |
| 2022/0256941 | A1 | 8/2022 | Suess | |

FOREIGN PATENT DOCUMENTS

| | | | |
|---|---|---|---|
| DE | 202019102472 | U1 | 5/2019 |
| EP | 0649608 | A1 | 4/1995 |
| JP | 3507011 | B2 | 3/2004 |
| JP | 2012162833 | A | 8/2012 |
| WO | 2019169575 | A1 | 9/2019 |
| WO | 2020073163 | A1 | 4/2020 |
| WO | 2021068917 | A1 | 4/2021 |
| WO | 2021081893 | A1 | 5/2021 |
| WO | 2022007922 | A1 | 1/2022 |
| WO | 2022155761 | A1 | 7/2022 |

OTHER PUBLICATIONS

Warner's, "Flex Revolution Contour Flexible Underwire," Style #RD3761A, May 13, 2020, available at https://web.archive.org/web/20200513224602/https://warners.com/intimates/flex-revolution-contour-flexible-underwire/.

Todaro et al., "Brassiere," U.S. Appl. No. 17/588,387, filed Jan. 31, 2022 (drawings, specification, and claims only).

Office Action issued in Chinese Patent Application No. 202210118986.7, dated Dec. 5, 2024, 7 pages.

Search Report issued in Chinese Patent Application No. 202210118986.7, dated Dec. 3, 2024, 2 pages.

* cited by examiner

BRASSIERE

CROSS-REFERENCE TO RELATED APPLICATION

The present application is a continuation of U.S. patent application Ser. No. 17/588,387, filed Jan. 31, 2022, which claims the benefit of U.S. Provisional Application No. 63/147,462, filed Feb. 9, 2021, both of which applications are hereby incorporated by reference herein.

FIELD

The present application relates to brassieres and garments incorporating brassieres or brassiere-like garments.

BACKGROUND

U.S. Pat. No. 7,427,226 discloses a women's breast support garment, e.g., bra, configured to promote wearer comfort by allowing a breast cup to move multi-directionally, or float, relative to a torso member. The bra construction is characterized by a limp intermediate strip at the junction between the lower edge of each breast cup and the upper edge of a torso member.

U.S. Pat. No. 9,480,287 discloses a bra having a front portion, a back portion, a torso band and a pair of shoulder straps. Areas of the front portion are selectively provided with an inner ply, an outer ply, and an intermediate fabric ply. The intermediate fabric ply is formed of a relatively supportive material and is configured to be positioned along the top and lateral sides of a wearer's breasts.

International Application Publication No. WO2020/073163 discloses an article of clothing and a method of manufacturing thereof. The article of clothing includes a first fabric layer and a second fabric layer. The article of clothing further includes an elastic mesh. The elastic mesh is sandwiched between the first fabric layer and the second fabric layer. Herein, the elastic mesh has higher elasticity along a first direction as compared to a second direction thereof. The elastic mesh is heat sealed to at least one of the first fabric layer or the second fabric layer.

Warner's sells a bra called "FLEX REVOLUTION® Contour Flexible Underwire" that has mesh insets located below the underwire at the lower, outer edges of each cup and located below the underwire where the cups connect at the center front of the bra.

Victoria's Secret sold a brassiere in their "Body by Victoria" collection around 1998 in which the foam pad of each breast cup was not attached to the metal underwire supporting the breast cup, other than by way of the inner and/or outer liner fabric of the breast cup.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example, the present disclosure is of a brassiere comprising a chest band configured to encircle and lay against a wearer's ribcage. A portion of the chest band includes a pair of concavities, and each concavity in the pair of concavities is configured to be located below one of a wearer's breasts when the brassiere is worn. A pair of curved support members is attached to the chest band along the pair of concavities, respectively. The brassiere includes a pair of breast cups, each breast cup being situated within a respective concavity in the pair of concavities. Each breast cup comprises an inner liner, an outer liner, and a foam pad sandwiched between the inner and outer liners. The inner and/or outer liner of each breast cup is attached to the chest band along the respective concavity. The foam pad of each breast cup is not attached to the chest band, other than by way of the inner and/or outer liner. The chest band comprises an inner layer configured to touch a wearer's skin, an outer layer configured to face outwardly from the wearer, and an intermediate layer sandwiched between the inner and outer layers.

According to one example, a lower region of the inner liner of each breast cup extends past a lower edge of the foam pad and a lower edge of the outer liner of each breast cup, and a lower portion of the lower region of the inner liner of each breast cup is overlapped with the chest band.

According to one example, the inner liner is made of a fabric that has a lower elastic modulus than that of the foam pad.

According to one example, an upper portion of the lower region of the inner liner of each breast cup that extends past the lower edges of the foam pad and the outer liner is not overlapped with the chest band.

According to one example, an upper edge of the intermediate layer of the chest band is overlapped with the lower portion of the lower region of the inner liner of each breast cup.

According to one example, the intermediate layer of the chest band is a mesh panel.

According to one example, the mesh panel is formed from an extruded polymer.

According to one example, the chest band comprises a foam frame at least in part defining the pair of concavities and configured to extend at least partially under a wearer's arms.

According to one example, the foam frame comprises an inner layer of foam and an outer layer of foam, and the pair of curved support members are embedded between the inner and outer layers of foam.

According to one example, a lower edge of the foam pad of each breast cup is thinner than a portion of the foam pad immediately above the lower edge.

According to another example, a brassiere comprises a chest band configured to encircle and lay against a wearer's ribcage. A portion of the chest band includes a pair of concavities, and each concavity in the pair of concavities is configured to be located below one of a wearer's breasts when the brassiere is worn. A pair of curved support members is attached to the chest band along the pair of concavities, respectively. The brassiere includes a pair of breast cups, each breast cup being situated within a respective concavity in the pair of concavities. Each breast cup comprises an inner liner, an outer liner, and a foam pad sandwiched between the inner and outer liners. The inner and/or outer liner of each breast cup is attached to the chest band along the respective concavity. The foam pad of each breast cup is not attached to the chest band, other than by way of the inner and/or outer liner. The chest band comprises a foam frame at least in part defining the pair of concavities and configured to extend at least partially under a wearer's arms.

According to one example, a lower region of the inner liner of each breast cup extends past a lower edge of the foam pad and a lower edge of the outer liner of each breast cup, and a lower portion of the lower region of the inner liner of each breast cup is overlapped with the chest band.

According to one example, an upper portion of the lower region of the inner liner of each breast cup that extends past the lower edges of the foam pad and the outer liner is not overlapped with the chest band.

According to one example, the chest band further comprises an inner layer configured to touch a wearer's skin, an outer layer configured to face outwardly from the wearer, and an intermediate layer sandwiched between the inner and outer layers. The foam frame is also sandwiched between the inner and outer layers of the chest band.

According to one example, an upper edge of the intermediate layer is overlapped with the lower portion of the lower region of the inner liner of each breast cup.

According to one example, the intermediate layer is a mesh panel.

According to one example, the mesh panel is formed from an extruded polymer.

According to one example, the foam frame comprises an inner layer of foam and an outer layer of foam, and the pair of curved support members are embedded between the inner and outer layers of foam.

According to one example, a lower edge of the foam pad of each breast cup is thinner than a portion of the foam pad immediately above the lower edge.

According to one example, the inner liner of each breast cup is made of a fabric that has a lower elastic modulus than that of the foam pad of each breast cup.

BRIEF DESCRIPTION OF DRAWINGS

The present disclosure is described with reference to the following Figures. The same numbers are used throughout the Figures to reference like features and like components.

DETAILED DESCRIPTION

Figure 1:
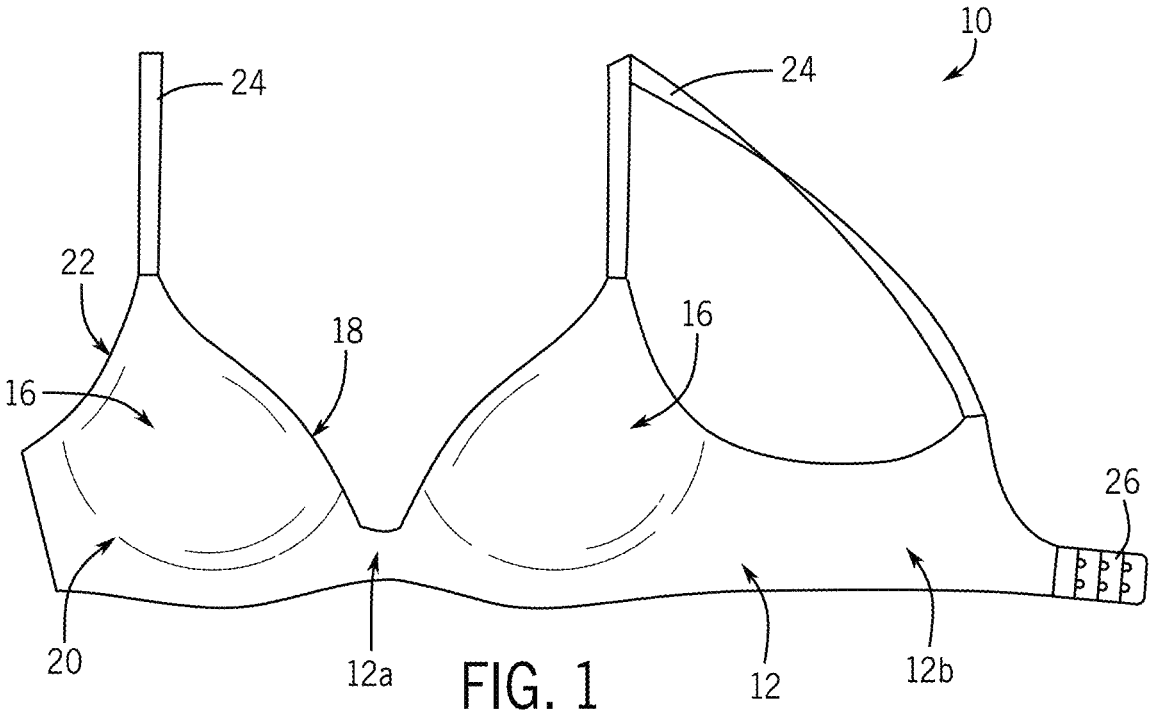
FIG. 1 illustrates an outer face of a brassiere according to the present disclosure.
Figure 2:
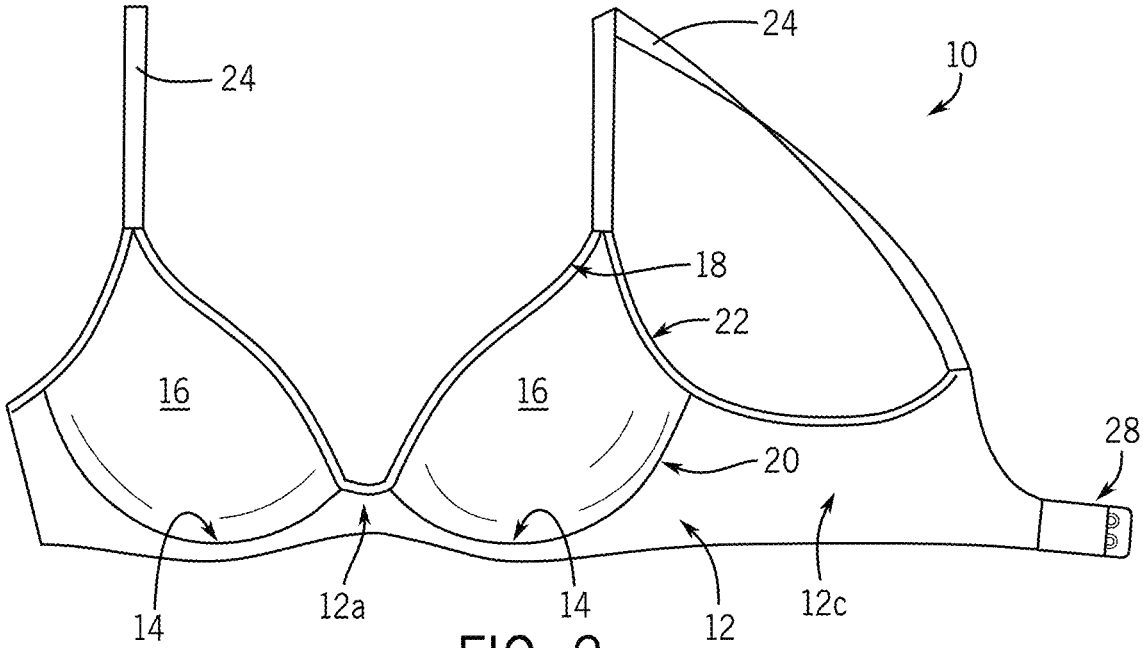
FIG. 2 illustrates the inner face of the brassiere.

FIGS. 1 and 2 illustrate a brassiere 10 according to the present disclosure. FIG. 1 shows an outer face of the brassiere 10 (i.e., what would be seen when the brassiere 10 is worn by a wearer), while FIG. 2 shows an inner face of the brassiere 10 (i.e., the portions that would touch the wearer's skin). The brassiere 10 includes a chest band 12 configured to encircle and lay against a wearer's ribcage. The chest band 12 is comprised of an underbust portion 12*a* ("cradle") and a wing portion 12*b*. Although only one wing portion 12*b* is shown in FIG. 1, those having ordinary skill in the art would understand that another wing portion 12*c* (see FIG. 2) extends from the other side of the underbust portion 12*a*. Referring more specifically to FIG. 2, a portion of the chest band 12 includes a pair of concavities 14, each concavity in the pair of concavities 14 configured to be located below one of a wearer's breasts when the brassiere 10 is worn.

The brassiere 10 further includes a pair of breast cups 16, each breast cup being situated within a respective concavity in the pair of concavities 14. Each breast cup 16 has an upper edge 18, a lower edge 20, and an underarm edge 22. The brassiere 10 also includes straps 24, an eye closure part 26, and a hook closure part 28. As is known, the hook closure part 28 can be connected to the eye closure part 26 to secure the chest band 12 around the wearer's ribcage. In other examples, the brassiere 10 is strapless and/or has stretchy wings 12*b*, 12*c* that allow a wearer to put on and take off the brassiere 10 by pulling it over her head. In still another example, the brassiere 10 is a front-close brassiere, with one back band extending from the outer edge of one breast cup 16 to the outer edge of the other breast cup 16.

Figure 3:
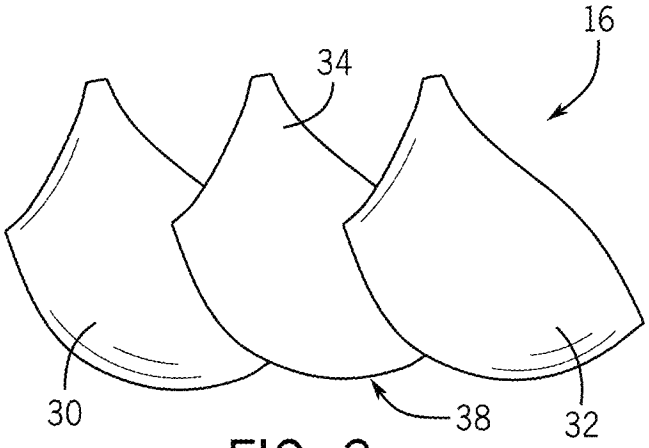
FIG. 3 illustrates an exploded view of the layers in a breast cup of the brassiere.
Figure 4:
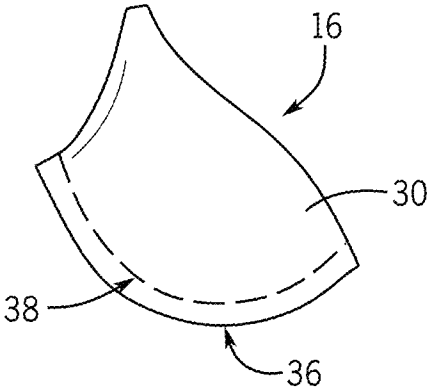
FIG. 4 illustrates the layers of FIG. 3 combined into a breast cup.

Turning to FIGS. 3 and 4, each breast cup 16 comprises an inner liner 30, an outer liner 32, and a foam pad 34 sandwiched between the inner and outer liners 30, 32. (Note, however, that the outer liner 32 is not the outer finished face of the brassiere 10. Rather, that is provided by outer layer 50, described herein below.) The inner and outer liners 30, 32 can be knitted of fabric such as polyester, spandex, nylon, and/or blends thereof, and can have a lower modulus of elasticity that that of the foam pad 34. The foam pad 34 may nonetheless be somewhat stretchy compared to foam pads generally used in brassiere pads. The layers 30, 32, 34 shown in FIG. 3 can be laminated and/or molded together using adhesive and a heat treating/molding process to form the breast cup 16*a* of FIG. 4. (Note that breast cups 16 are mirror images of one another, and thus only one will be described further herein.) According to the present disclosure, a lower region 36 of the inner liner 30 of each breast cup 16*a* extends past a lower edge of the foam pad 34 and a lower edge of the outer liner 32 of each breast cup 16. The lower edges of the foam pad 34 and outer liner 32 may coincide with one another and may be located along the dashed line 38 shown in FIG. 4 (it being understood that the foam pad 34 and the outer liner 32 are behind the inner liner 30 in this view). In another example, the lower regions of the inner liner 30 and outer liner 32 both extend past the lower edge 38 of the foam pad 34. The purpose of such a construction, in which the lower edge 38 of the foam pad 34 does not extend as far as the lower edge of at least one of the inner and outer liners 30, 32 will be described further herein below.

Figure 5:
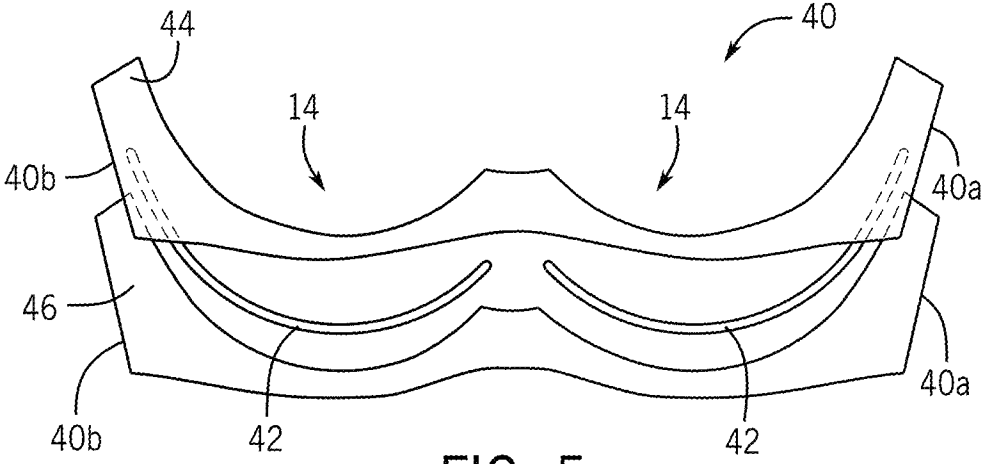
FIG. 5 illustrates an exploded view of the layers in a foam frame for a chest band of the brassiere.

Turning to FIG. 5, the chest band 12 comprises a foam frame 40 at least in part defining the pair of concavities 14. The brassiere 10 also includes a pair of curved support members 42. The foam frame 40 comprises an inner layer of foam 44 (which is closer to the wearer's body when worn) and an outer layer of foam 46 (which is further from the wearer's body), and the pair of curved support members 42 are embedded between the inner and outer layers of foam 44, 46. The curved support members 42 can be made of a flexible plastic or other type of polymer, and in one example are made of thermoplastic polyurethane. In another example, the curved support members 42 are made of foam, such as lengths of relatively more dense foam than the foam of the inner and outer layers of foam 44, 46. When molded between the inner and outer layers of foam 44, 46, the curved support members 42 can be fused thereto by application of heat and pressure. This adds strength to the molded composite chest band 12, as well as prevents poke-through of the support members. In other examples, the curved support members 42 and inner and outer layers of foam 44, 46 can be attached together using adhesive. In this manner, the pair of curved support members 42 are attached to the chest band 12 along the pair of concavities 14, respectively. The pair of curved support members 42 can be located such that their upper edges are a few millimeters below the upper edges of the layers of foam 44, 46 or can be located such that their upper edges coincide with the upper edges of the layers of foam 44, 46.

The outer side edges 40*a*, 40*b* of the foam frame 40 can be configured to extend at least partially circumferentially around a wearer's torso under the wearer's arms, in order to provide support to her breasts and to smooth any underarm bulge. For example, the outer side edges 40*a*, 40*b* can extend to locations under a wearer's arms that are halfway between her front side and her back side. In some examples, these outer side edges 40*a*, 40*b* are compressed, for example by molding, to increase their density and provide more support than the remainder of the chest band 12. In general, however, the foam frame 40 is located mostly in the underbust area 12*a* of the chest band 12.

The underbust area 12*a* of the chest band 12 could be formed other than as described herein above. In one example, the curved support members 42 are made of metal, like traditional underwires, and optionally may be coated with a gel-like material or surrounded by an underwire casing and/or foam. In some examples, no curved support members are provided. Instead, for example, the entire underbust area 12*a* of the brassiere 10 could include a sheet or film of thermoplastic material, such as thermoplastic polyurethane, secured between inner and outer layers of fabric and/or foam. In still other examples, the underbust area 12*a* has no added support between the inner and outer layers of foam 44, 46, such as for a maternity, lounge, or sleep brassiere.

Figure 6:
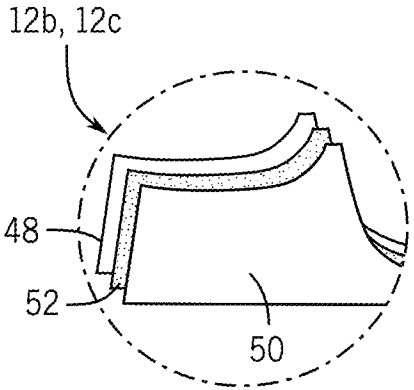
FIG. 6 illustrates an exploded view of the layers in a portion of a wing of the chest band.

As shown in FIG. 6, the wings 12*b*, 12*c* of the chest band 12 are comprised of an inner layer 48 configured to touch a wearer's skin, an outer layer 50 configured to face outwardly from the wearer, and an intermediate layer 52 sandwiched between the inner and outer layers 48, 50. In one example, the inner and outer layers 48, 50 are fabric similar to the fabric of the breast cup liners 30, 32, although one or both layers 48, 50 could be a mesh to provide a cooling effect to the wearer. In some examples, especially if the brassiere 10 is strapless, the inner layer 48 can be made of a fabric that inherently grips the wearer's skin, such as 100% spandex. In still other examples, the inner layer 48 may be brushed or otherwise treated to provide softness against the wearer's skin.

The intermediate layer 52 may be a panel of mesh or netting. In some examples, the mesh can be a non-woven material. The mesh may be formed from a gravure printed or extruded polymer, such as polystyrene. More particularly, the mesh panel may be made of 100% polystyrene. Other appropriate materials for the mesh are polyolefin or shape memory polymers. Some appropriate materials of this type are available from Meiwa Gravure Co., Ltd. of Higashi-Osaka City, Japan. Otherwise, the mesh may be formed of a polymer that is screen printed or 3-D printed onto a release sheet and then removed once set for incorporation into the wings 12*b*, 12*c*. In other examples, the polymer could be directly applied onto the inner or outer layer 48, 50 of fabric in a mesh pattern. If the intermediate layer 52 is made of netting, the netting may be a woven fabric netting. For example, the netting may comprise polyethylene and thermoplastic elastomer threads. Some other types of appropriate mesh and/or netting are sold under the trademark CONWED™ from Schweitzer-Mauduit International, Inc. of Alpharetta, Georgia. The mesh or netting may have any shape of apertures, such as square, diamond, circular, ovular, parallelogram, or rectangular. The size of the apertures will generally be on the order of 1 to 3 millimeters or less. In one particular example, the size of the apertures is on the order is 0.5 to 1.5 millimeters, preferably 0.8 to 1.1 millimeters. The thickness of the mesh or netting may be 100 to 160 microns, and preferably 130 microns. The porosity (fraction of open area to total area) of the mesh or netting may be 30 to 50%, or more particularly 35 to 40%. The mesh or netting may have a weight of 30 to 70 gsm, or more particularly 50 gsm.

In one particular example, a 100% polystyrene mesh that is 130 microns thick and has a weight of 50 gsm, with apertures measuring 0.9 to 1.1 millimeters in one direction and 0.8 to 0.95 millimeters in a direction transverse thereto, and an average porosity of 40%, has an elongation of about 120% from 0.1 kg to 1 kg and a recovery of about 88%. The elongation and recovery do not change significantly with temperature, such as when the mesh is on-body as part of the brassiere 10. Thus, incorporating the mesh into the brassiere 10 can provide high stretch and fast recovery to the fabric laminate. Note that the overall stretch and recovery will depend on the fabrics with which the mesh is laminated, and in one example, the inner and outer layers 48, 50 on either side of the intermediate layer are nylon-spandex.

The layered construction of the wings 12*b*, 12*c* provides enhanced elasticity to the wings, smoothing back and underarm bulge while still being tight enough around her ribcage to hold the brassiere 10 in place and support her breasts. The intermediate layer 52 may have more stretch and recovery capabilities than the inner and outer layers 48, 50. Thus, use of the mesh/netting between the inner and outer layers 48, 50 of fabric stabilizes the inner and outer layers 48, 50 of fabric at their edges and provides overall stretch and elasticity to the wings 12*b*, 12*c*. This allows the upper and lower edges of the wings 12*b*, 12*c* potentially to be raw cut and bonded to each other and to the intermediate layer 52 by adhesive, such as through lamination and/or molding (i.e., no stitching is required). Additionally, because the intermediate layer 52 provides stretch and recovery over the entire height and length of the wings 12*b*, 12*c*, and even in the underbust area 12*a*, no separate elastic band is required along the top and/or bottom edges of the wings 12*b*, 12*c*, as in typical brassieres. This eliminates digging in of the wings 12*b*, 12*c* and provides the look of a smooth underarm and back area under her clothing, while still providing a fit that is tight enough to her body to support her breasts. Note that in other examples, the intermediate layer 52 may be provided only near the top and/or bottom edges of the wings 12*b*, 12*c*, and optionally an elastic band could be provided where the intermediate layer 52 is not present. In still other examples, elastic bands (which can be knit or woven or made of a thermoplastic tape/film) can be provided at the top and/or bottom edges of the wings 12*b*, 12*c*, even with the intermediate layer 52 extending the full height and length thereof, to provide increased support, but the elastic bands need not be as tight as they might otherwise have been required to be were the intermediate layer 52 not provided.

Figure 7:
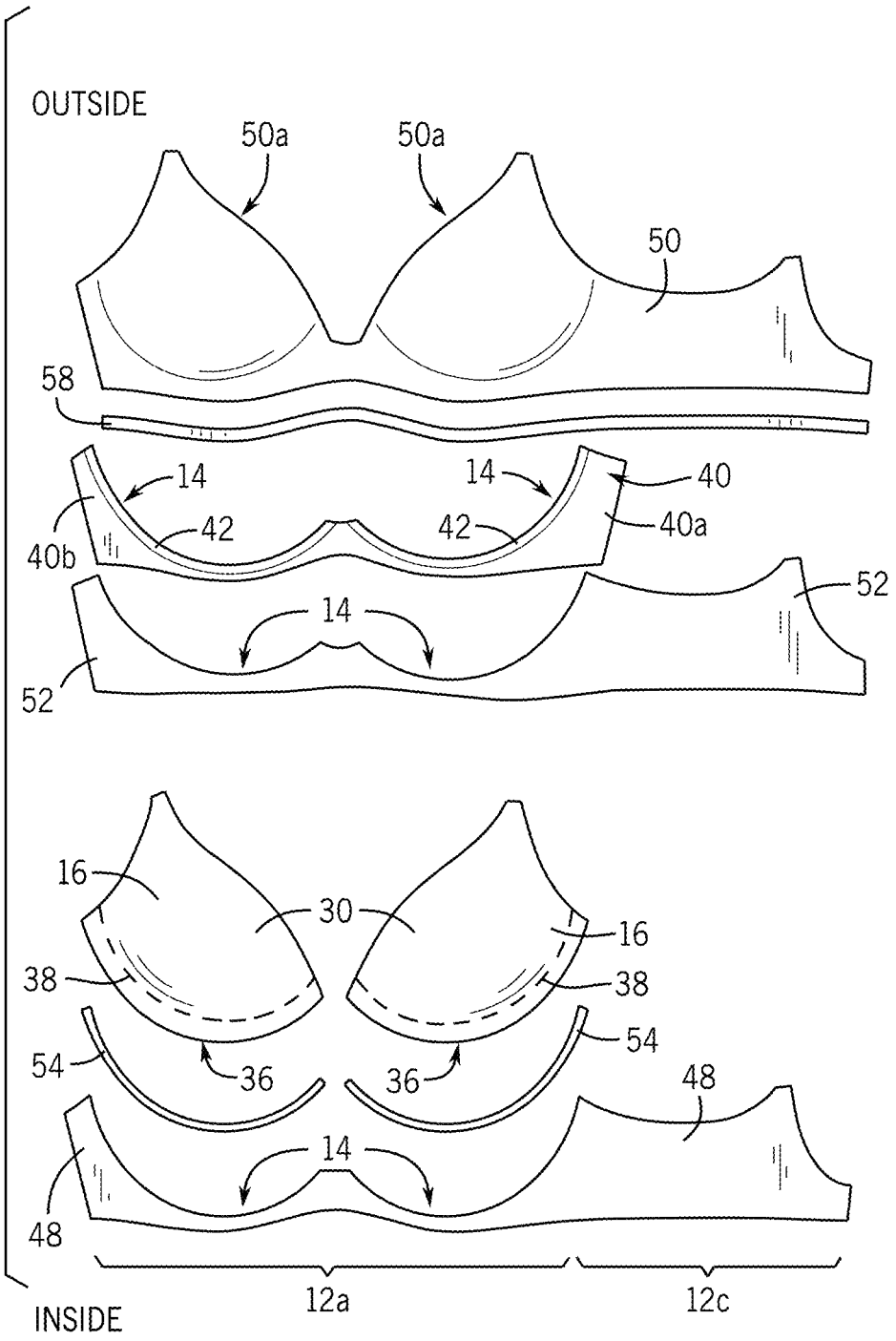
FIG. 7 is an exploded view of layers of the brassiere in an unassembled state.

Now turning to FIG. 7, the layers of the brassiere 10 are shown exploded to describe how they are molded together. FIG. 7 shows the outer layers toward the top of the figure, progressing to the inner layers toward the bottom of the figure. The layers are placed in a female part of a mold in order from top (outside of the garment) to bottom (inside of the garment).

The outermost layer, which is the outer layer 50 described with respect to the wings 12*b*, 12*c* in FIG. 6, is first placed in the female part of the mold. The outer layer 50 extends not only across both wings 12*b*, 12*c*, but also across the entire front of the brassiere 10, including the breast cups 16 and the underbust area 12*a*. A strip of adhesive 58 (such as silicone adhesive) is placed at the lower edge of the outer layer 50 in order to bond the outer layer 50 to the foam frame 40 and the intermediate layer 52, which are placed on top of the outer layer 50. In another example, the outer layer 50 is bag-out sewn to the inner layer 48 of each wing 12*b*, 12*c* and to the inner layer of fabric in the underbust area 12*a*. Additional adhesive such as spray glue, printed glue, or glue dots can also be applied to the outer layer 50 in select locations, for example to adhere the outer layer 50 to the intermediate layer 52 along the entire height and length of the wings 12*b*, 12*c* and/or to adhere the outer layer 50 to the foam frame 40 in the underbust area 12*a*. In another example, these layers 50, 48, 52 are connected only along their outer edges. Additionally or alternatively, by purposeful application of adhesive, the outer layer 50 may be loose (non-adhered) where it covers the breast cups 16, but adhered to the remainder of the layers of the brassiere 10 in the chest band 12. In yet another example, the outer layer 50 may be loose (non-adhered) where it covers the breast cups 16 and the underbust area 12*a*, but may be adhered where it covers the wings 12*b*, 12*c*. In such an example, if the intermediate layer 52 that is used in the wings 12*b*, 12*c* is self-bonding by application of heat and pressure, little or no adhesive may be required to bond the outer layer 50 to the intermediate layer 52 in the wings 12*b*, 12*c*. For example, a 100% polystyrene mesh as noted above can be self-bonded to nylon-spandex fabric upon application of 3-5 bar of pressure at 150-180 degrees C. for 10-20 seconds. Self-bonding of the mesh to the fabric allows the garment to be breathable and have a soft hand-feel, which might not otherwise be the case if additional adhesive was required.

The foam frame 40 may be pre-assembled before being placed in the mold, such as by lamination and/or molding to a shape configured to curve around her ribcage. The foam frame 40, complete with embedded curved support members 42, is placed on top of the outer layer 50, with the concavities in the foam frame 40 aligned with the edges of the concavities in the female part of the mold. In another example, the layers of foam 44, 46 and curved support members 42 are placed into the garment mold separate from one another, without being preassembled, but with adhesive placed therebetween. The inner layer of foam 44 may be coated with adhesive to bond it with the intermediate layer 52, or the intermediate layer 52 may self-bond to the inner layer of foam 44 upon application of heat and pressure.

The intermediate layer 52, which is the same as the intermediate layer 52 described with respect to FIG. 6, is then placed on top of the foam frame 40 and the outer layer 50. Again, the concavities in each layer are aligned during such placement. Note that the intermediate layer 52 extends not only across the wings 12*b*, 12*c*, but also across the underbust area 12*a*. In other examples, however, the intermediate layer 52 is located only along the wings 12*b*, 12*c* or only in the underbust area 12*a*. The intermediate layer 52 may be coated with more adhesive, or the adhesive that was applied to the outer layer 50 may be able to extend through the holes in the mesh of the intermediate layer 52 and bond to the inner layer 48 of the brassiere 10. In some examples, by purposeful application of adhesive in the wings 12*b*, 12*c*, the intermediate layer 52 can be adhered to the inner and outer layers 48, 50 of fabric in strips extending only a few centimeters inward from the edges of the wings 12*b*, 12*c*, with the middle vertical extent of the wings 12*b*, 12*c* being left unadhered. Alternatively, if the intermediate layer 52 is self-bonding by application of heat and pressure, heat and pressure can be applied only along the upper and lower edges of the wings 12*b*, 12*c*, if desired.

The breast cups 16 are then placed into the concavities in the female part of the mold, with their lower edges 38 aligned with the concavities 14 defined by the foam frame 40 and the intermediate layer 52. The breast cups 16 can be pre-assembled and even molded to a cup shape prior to insertion in the garment mold. In other examples, the breast cups 16 are laminated but not molded before being placed in the garment mold with the other layers of the brassiere 10. In still other examples, each of the three layers of the breast cups 16 is loose before being placed into the garment mold, and adhesive is applied between each layer, which layers are then bonded together in the garment mold. The breast cups 16 are situated in the garment mold in a manner such that the foam pads 34 in the breast cups 16 do not touch or overlap with the components of the chest band 12, specifically, the foam frame 40 and the intermediate layer 52, as will now be described.

Figure 8:
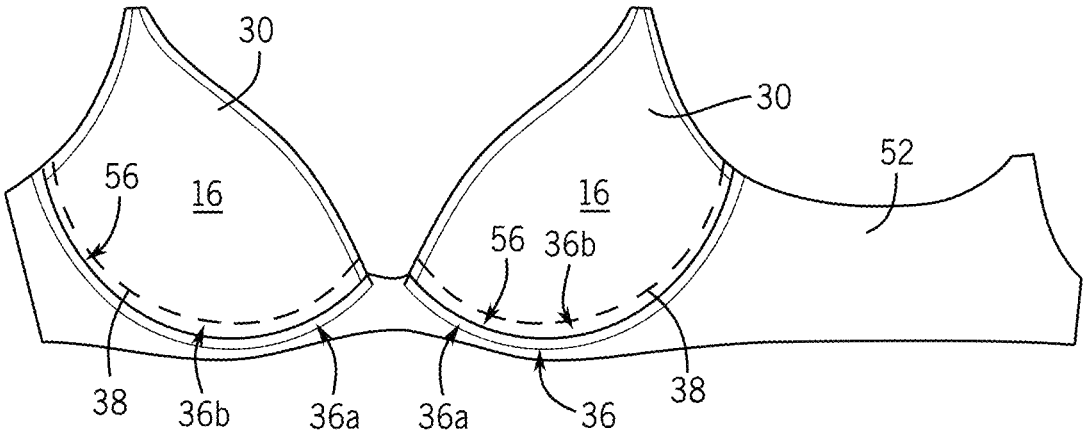
FIG. 8 illustrates portions of the brassiere in a partially assembled state, viewed from the inner face.

Referring briefly to FIG. 8, a lower portion 36*a* of the lower region 36 of the inner liner 30 of each breast cup 16*a*, 16*b* is overlapped with an upper edge 56 of the intermediate layer 52 (and the corresponding upper edge of the foam frame 40 behind the intermediate layer 52) in the concavities 14. Meanwhile, an upper portion 36*b* of the lower region 36 of the inner liner 30 of each breast cup 16 that extends past the lower edges 38 of the foam pad 34 and the outer liner 32 is not overlapped with the intermediate layer 52, and indeed does not overlap with any layer of the chest band 12 but the outer layer 50. Similarly, only the lower portions 36*a* of the lower regions 36 of the inner liner 30, but not the upper portions 36*b* thereof, are overlapped with the upper edge of the foam frame 40. Thus, between (a) the overlapped foam frame 40, intermediate layer 52, and lower portion 36*a* of the lower region 36 of the inner liner 30 and (b) the lower edge 38 of the foam pad 34, only the upper portion 36*b* of the lower region 36 of the inner liner 30 connects the breast cups 16 to the chest band 12 on the inner face of the brassiere 10. (Note that the outer layer 50 couples the breast cups 16 to the chest band 12 on the outer face of the brassiere 10.)

Returning to FIG. 7, adhesive strips 54, which may be made of silicone, are then placed on the breast cups 16 below the lower edges 38 of the foam pads 34. More specifically, the adhesive strips 54 are placed on top of the lower portions 36*a* of the lower regions 36 of the inner liner 30. The innermost layer of the chest band 12, which is the inner layer 48 described with respect to FIG. 6, is then placed into the mold. It can be seen that the inner layer 48 extends not only along the wings 12*b* (and 12*c*, although not shown herein), but also across the underbust area 12*a* of the chest band 12. In the present example, the inner layer 48 is formed of a single piece of fabric, to provide a seamless surface touching her skin. However, in other examples, two or more pieces of fabric could be sewn or bonded together to form the inner layer 48. The inner layer 48 is aligned such that the upper edges of the concavities therein are situated on top of the adhesive strips 54, specifically such that no non-adhered portion of the inner layer 48 is located above the adhesive strips 54.

In some examples, the upper edges 50*a* of the outer layer 50 are then folded over the inner liner 30 of the breast cups 16 and bonded thereto using elastic adhesive strips at the upper edges 18 and underarm edges 22 to form smooth upper edges. See FIGS. 2 and 9. The edges of the wings 12*b*, 12*c* can be raw cut if the layers 48, 52, 50 are laminated together. The edges of the wings 12*b*, 12*c* can alternatively be finished by sewing (e.g., bag-out) and/or bonding.

Figure 9:
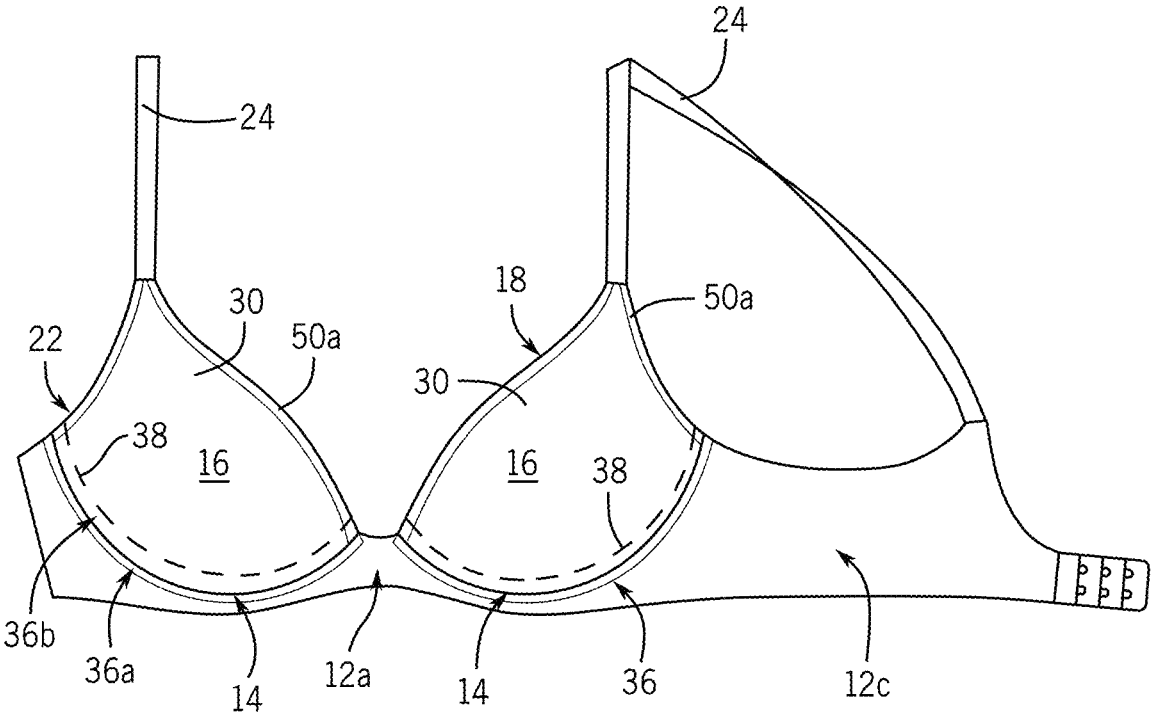
FIG. 9 illustrates the inner face of the brassiere, once assembled, in more detail.

FIGS. 8 and 9 provide further detail related to the connection of the breast cups 16 to the foam frame 40, intermediate layer 52, and inner layer 48. As mentioned, the inner and/or outer liner 30, 32 of each breast cup 16 extends past the lower edge 38 of the foam pad 34. According to the present disclosure, at least one of the inner and outer liners 30, 32 of each breast cup 16 is attached to the chest band 12 along a respective concavity 14 therein. As described herein above, the inner liner 30 is the one connected to the chest band 12, such as by the adhesive strips 54 connecting the lower portion 36*a* of the lower region 36 of the inner liner 30 to the inner layer 48 and the intermediate layer 52 being overlapped with and adhered to the lower portion 36*a* of the lower region 36 of the inner liner 30. The foam pad 34 of each breast cup 16 (the lower edge of which is shown at 38) is not attached to the chest band 12, other than by way of the at least one of the inner and outer liners 30, 32 (here, by way of the inner liner 30). Because the lower portion 36*a* of the lower region 36 of the inner liner 30 of each breast cup 16 is overlapped with the chest band 12, and this overlap is sealed with adhesive strips 54, the wearer is not able to feel the "seam" created here. Although extending the inner liner 30 past the lower edge 38 of the foam pad 34 provides this benefit, in other examples, it may be only an extended lower edge of the outer liner 32 that is overlapped with and connected to the components of the chest band 12. In other examples, both the inner and outer liners 30, 32 are overlapped with the components of the chest band 12. However, by leaving a gap between the lower edge 38 of the foam pad 34 and the chest band 12, especially between the lower edge 38 of the foam pad 34 and the curved support members 42 in the chest band 12, the brassiere 10 is provided with increased flexibility and comfort.

In some examples, the lower edge 38 of the foam pad 34 of each breast cup 16 is thinner than a portion of the foam pad 34 immediately above the lower edge 38. For example, the lower edge 38 can be shaved down to almost nothing in order to prevent a noticeable ridge where the foam pad 34 stops and the breast cup 16*a*, 16*b* comprises just the inner liner 30. If extra support is needed in this area, the lower edge 38 of the foam pad 34 can instead be compressed to provide a more dense, supportive area that is still thinner than the remainder of the foam pad 34 above it.

In one example, the inner liner 30 extends ¼" to ⅝" beyond the lower edge 38 of the foam pad 34. In a more specific example, the inner liner 30 extends ⅜" to ½" beyond the lower edge 38 of the foam pad 34. In a still more specific example, the inner liner 30 extends 7/16" beyond the lower edge 38 of the foam pad 34. In one example, ⅛" to ⅜" of the lower region 36 of the inner liner 30 overlaps with the chest band 12. In a more specific example, 3/16" to 5/16" of the lower region 36 of the inner liner 30 overlaps with the chest band 12. In a still more specific example, ¼" of the lower region 36 of the inner liner 30 overlaps with the chest band 12. In some examples, between 1/16" and 5/16" of the inner liner 30 is left not overlapped with either the foam pad 34 or the chest band 12 and can flex with the wearer's movement and changing breast size. In a more specific example, ⅛" to ¼" of the liner layer 30 is not overlapped with any other layer of the brassiere 10 but the outer layer 50. In a still more specific example, 3/16" of the liner layer 30 is not overlapped with any other layer of the brassiere 10 but the outer layer 50.

Figure 10:
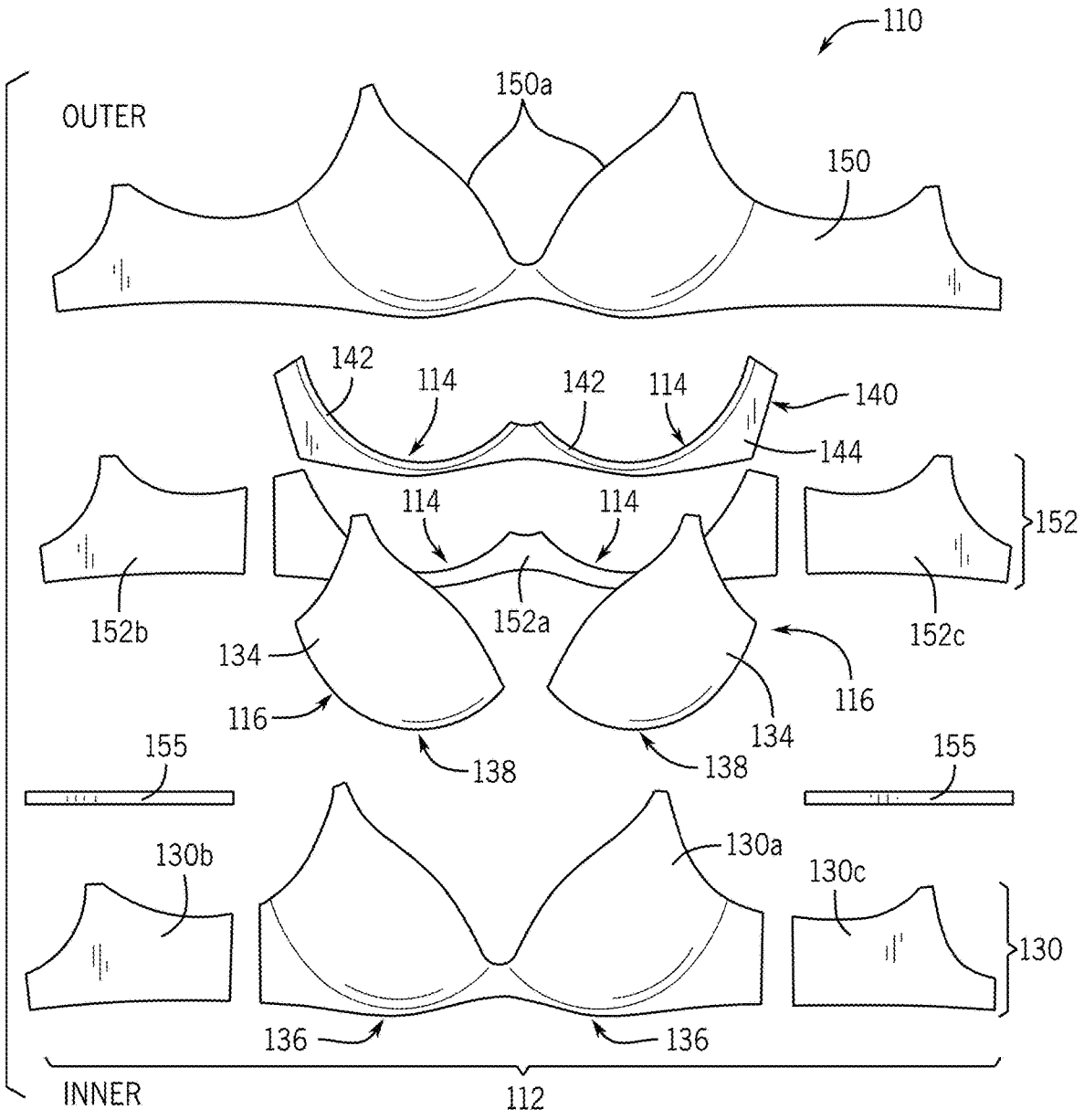
FIG. 10 is an exploded view of layers of another example of a brassiere according to the present disclosure, in which the brassiere is in an unassembled state.
Figure 11:
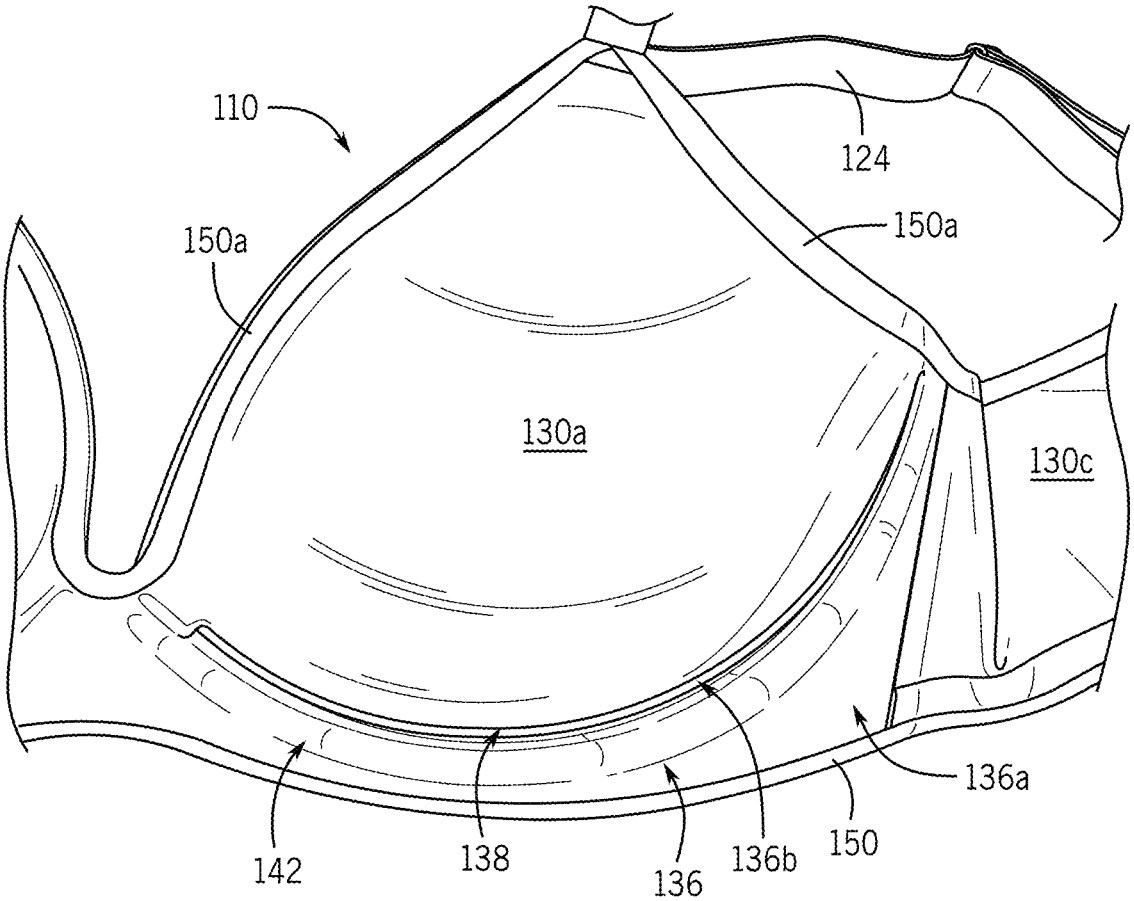
FIG. 11 shows a cup and wing of the brassiere of FIG. 10, viewed from an inner face of the brassiere.
Figure 12:
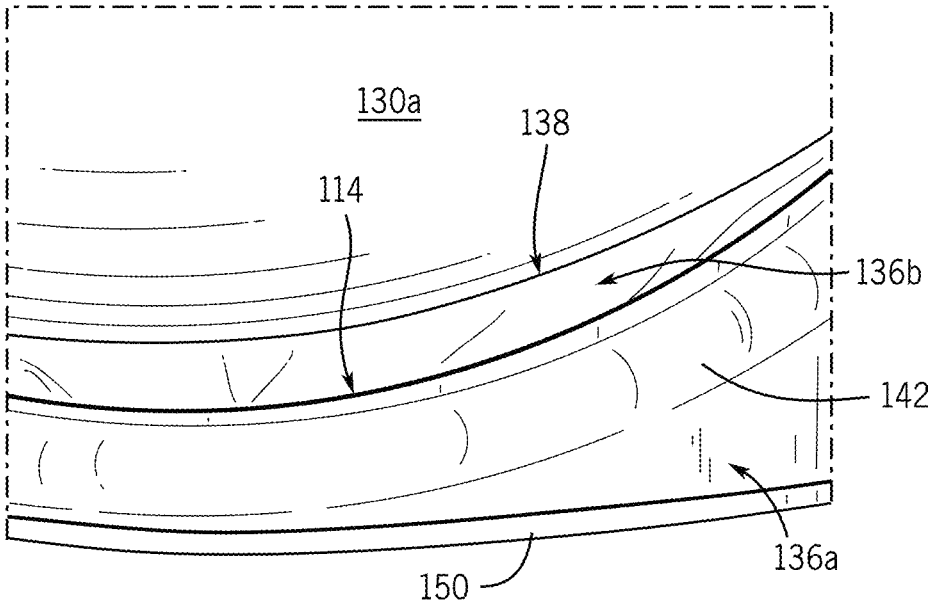
FIG. 12 shows a close-up view of the cup of the brassiere of FIG. 10 viewed from the inner face of the brassiere.
Figure 13:
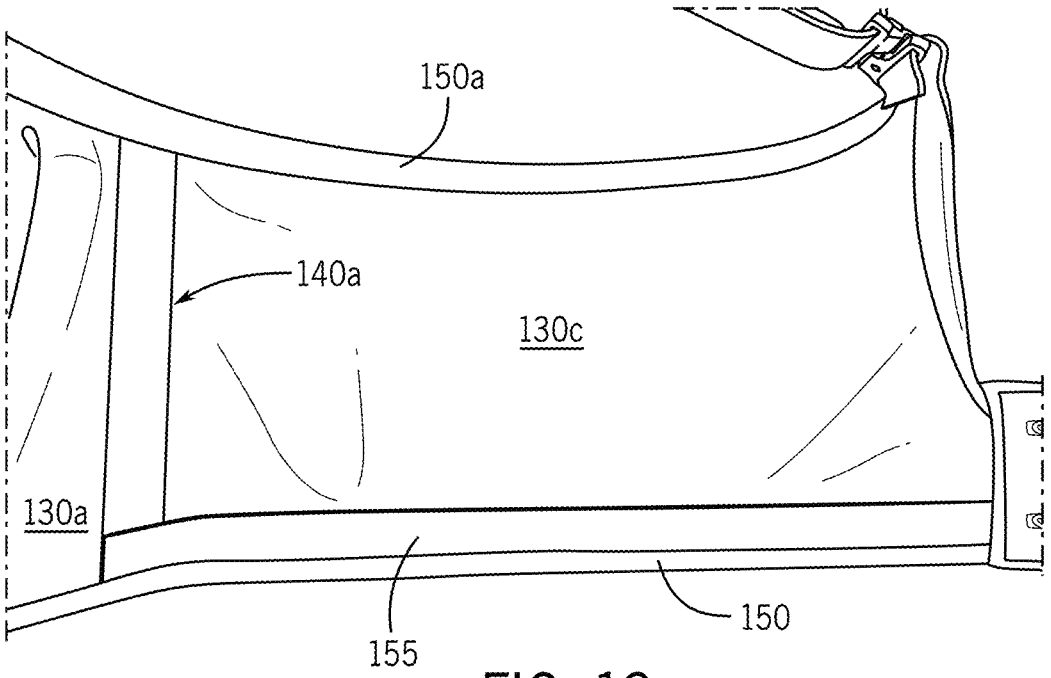
FIG. 13 shows a close-up view of the wing of the brassiere of FIG. 10, viewed from the inner face of the brassiere.

Another example of a brassiere 110 according to the present disclosure is shown in FIGS. 10-13. Note that like components in the second example shown in FIGS. 10-13 are labeled with a "1" in the hundreds place, such that the breast cup 116 corresponds to the breast cup 16 of the first example of FIGS. 1-9, the chest band 112 corresponds to the chest band 12 of the first example, and so on. Thus, where the components provide the same function and are manufactured in the same (or similar) manner as in the first example, those components will not be described further herein below, it being understood that the above description of those components applies equally to the second example of the brassiere in FIGS. 10-13. Unless otherwise indicated, the above descriptions of the materials used in the brassiere 10 apply equally to the materials used in the brassiere 110. Further, although only one breast cup 116 and wing 112*b* are shown in FIGS. 11-13, it should be understood that another cup and wing are provided on the other half of the brassiere in the same manner, as shown in FIG. 10.

FIG. 10 shows an unassembled brassiere 110 comprising a chest band 112 configured to encircle and lay against a wearer's ribcage, a portion of the chest band 112 including a pair of concavities 114, each concavity in the pair of concavities 114 configured to be located below one of a wearer's breasts when the brassiere 110 is worn. As with FIG. 7, the layers of the brassiere 110 are shown with the outer layers toward the top of the figure, progressing to the inner layers toward the bottom of the figure. A pair of curved support members 142 is attached to the chest band 112 along the pair of concavities 114, respectively. A pair of breast cups 116 is also provided. Each breast cup 116 is situated within a respective concavity in the pair of concavities 114, and each breast cup 116 comprises an inner liner 130, an outer liner (on reverse side of breast cups 116, not shown), and a foam pad 134 sandwiched between the inner and outer liners, as described with respect to FIG. 3. At least one of the inner and outer liners of each breast cup 116 is attached to the chest band 112 along the respective concavity 114. The foam pad 134 of each breast cup 116 is not attached to the chest band 112, other than by way of the at least one of the inner and outer liners. Here, only the inner liner 130 connects the foam pads 134 of the breast cups 116 to the chest band 112, as will be described herein below.

As described with respect to FIGS. 6 and 7, the chest band 112 comprises an inner layer configured to touch a wearer's skin, an outer layer 150 configured to face outwardly from the wearer, and an intermediate layer 152 sandwiched between the inner and outer layers. The intermediate layer 152 of the chest band 112 may be a mesh or netting, as described hereinabove. Here, in contrast to the first example, the inner layer of the chest band 112 is the same as the inner liner 130 of the breast cups 116. In other words, referring now also to FIGS. 11 and 12, the inner liner 130 of the breast cups 116 extends as one continuous piece of fabric downwardly from the breast cups 116, spans the gaps between the lower edges 138 of the foam pads 134 in the breast cups 116 and the upper edges of the concavities 114, and extends to the lower edge of the chest band 112, where the inner liner 130 is bag-out sewn to the outer layer 150 of the brassiere 110. As with the first example, the chest band 112 also comprises the foam frame 140 at least in part defining the pair of concavities 114 and configured to extend at least partially under a wearer's arms. For example, the lateral-most extent of the foam frame 140 is shown at 140*a* in FIG. 13. As described with respect to FIG. 5, the foam frame 140 of the chest band 112 comprises an inner layer of foam 144 and an outer layer of foam (on reverse), and the pair of curved support members 142 are embedded between the inner and outer layers of foam.

As with the first example, the lower region 136 of the inner liner 130 of each breast cup 116 extends past the lower edge 138 of each foam pad 134 and past a lower edge of the outer liner (on reverse side of breast cups 116) of each breast cup 116. Further, referring to FIGS. 11 and 12, a lower portion 136*a* of the lower region 136 of the inner liner 130 of each breast cup 116 is overlapped with the chest band 112. An upper portion 136*b* of the lower region 136 of the inner liner 130 of each breast cup 116 that extends past the lower edges 138 of the foam pad 134 and the outer liner (on reverse) is not overlapped with the chest band 112. The inner liner 130 is made of a fabric that has a lower elastic modulus than that of the foam pads 134, thereby providing stretch in this "gap" between the lower edges 138 of the foam pads 134 and the upper edges of the concavities 114 in the chest band 112. Also as with the first example, an upper edge of the intermediate layer 152 of the chest band 112 (which upper edge also comprises the concavities 114) may be overlapped with the lower portion 136*a* of the lower region 136 of the inner liner 130 of each breast cup 116.

To assemble the brassiere 110 of FIGS. 10-13, the breast cups 116, the inner liner 130, the intermediate layer 152, and the foam frame 140 can first be molded together. The breast cups 116 and the foam frame 140 can first be placed in the female portion of the mold, with the lower edges 138 of the foam pads 134 of the breast cups 116 being spaced from the upper edges of the concavities 114 in the foam frame 140. The breast cups 116 may in this instance comprise only the foam pad 134 and the outer liner (on reverse), and adhesive can be applied to the inner face of the foam pads 134 for future bonding with the inner liner 130. The intermediate layer 152 can next be placed in the mold, overlapping the foam frame 140, but not the foam pads 134. The inner liner 130 can then be placed in the mold, and heat and pressure are applied to mold the inner liner 130 to the inner face of the foam pads 134 and to the intermediate layer 152. The inner liner 130 and the intermediate layer 152 in this example may be pieces of fabric only as wide as the underbust area 112*a* of the chest band 112 (see 130*a* and 152*a*, FIG. 10). Thus, the molded front panel subassembly of the breast cups 116, foam frame 140, intermediate layer 152*a*, and inner liner 130*a* is formed.

Referring specifically to FIGS. 10 and 12, the wings 112*b*, 112*c* of the brassiere 110 can then be formed by adhering and/or molding wing-shaped intermediate layers 152*b*, 152*c* and wing-shaped inner liners 130*b*, 130*c* to the outer lateral edges of the front panel subassembly. The outer layer 150 can then be sewn to the bottom edges of the front panel subassembly and the laminated wings 112*b*, 112*c*, and bagged out to fold the outer layer 150 over the front of the brassiere 110. A strip of elastic 155 is provided at the bottom of each wing 112*b*, 112*c*, either between the inner liners 130*b*, 130*c* and the intermediate layers 152*b*, 152*c* or between the intermediate layers 152*b*, 152*c* and the outer layer 150. The strips of elastic 155 can be knit or woven or made of a thermoplastic tape/film. The upper edge 150*a* of the outer layer 150 can be folded over the top edges of the front panel subassembly and the wings 112*c*, 112*c* and bonded or sewn thereto. By application of heat and pressure, the outer layer 150 can be bonded to the outer face of the intermediate layer 152, due to the self-bonding nature of the intermediate layer 152. Thus, the outer layer 150 may be loose (non-bonded) where it covers the breast cups 116 and the underbust area 112*a*, but may be bonded where it covers the wings 112*b*, 112*c*. Trims, such as the hook and eye closure parts, can then be attached to the ends of the wings 112*b*, 112*c*.

In still other examples of the brassieres 10, 110, the intermediate layer 52, 152 is not provided in the underbust area 12*a*, 112*a*, but only in the wings 12*b*, 12*c* and 112*b*, 112*c*. In this case, adhesive is applied to bond the inner layer 48 portion or the inner liner 130 to the foam frame 40, 140, as the self-bonding intermediate layer 52, 152 is not present.

Note that the present concepts can be applied to other types of brassieres and to brassiere-like garments. For example, the brassiere can be a sport brassiere, a long-line brassiere, or a nursing brassiere. The brassiere can be incorporated inside a covering garment, such as a camisole or a t-shirt. The structure shown and described herein can instead be part of a slip, dress, or swimsuit. Those having ordinary skill in the art will understand to what other types of garments the present concepts can be applied.

In the present description, certain terms have been used for brevity, clarity, and understanding. No unnecessary limitations are to be implied therefrom beyond the requirement of the prior art because such terms are used for descriptive purposes only and are intended to be broadly construed. The different assemblies described herein may be used alone or in combination with other systems. Various equivalents, alternatives, and modifications are possible within the scope of the appended claims.

What is claimed is:

1. A brassiere comprising:

a cradle configured to lay against a wearer's ribcage, the cradle comprising a foam frame including a pair of concavities, each concavity in the pair of concavities configured to be located below one of a wearer's breasts when the brassiere is worn;

a pair of curved support members attached to the cradle along the pair of concavities, respectively;

a pair of breast cups, each breast cup in the pair of breast cups being situated within a respective concavity in the pair of concavities and each breast cup comprising a foam pad;

an inner liner that extends continuously over an inner face of each of the foam pads of the pair of breast cups and over an inner face of the foam frame of the cradle;

a pair of wings, each wing in the pair of wings being coupled to a respective lateral side edge of the cradle;

an outer layer extending over the cradle, the pair of breast cups, and the pair of wings and forming an outer face of the brassiere;

wherein the foam pads of the pair of breast cups are attached to the inner liner; and wherein a majority of a lower edge of the foam pad of each breast cup is not attached to the foam frame of the cradle other than by way of the inner liner.

2. The brassiere of claim 1, wherein each wing in the pair of wings comprises an intermediate layer and an inner liner adjacent an inner face of the intermediate layer; and wherein the outer layer is bonded to an outer face of the intermediate layer of each wing.

3. The brassiere of claim 2, wherein the intermediate layer of each wing is a self-bonding panel.

4. The brassiere of claim 3, wherein the self-bonding panel is a polymer mesh.

5. The brassiere of claim 2, wherein the outer layer is not bonded to an outer face of either of the breast cups in the pair of breast cups.

6. The brassiere of claim 1, wherein the inner liner is one continuous piece of fabric that extends downwardly from the pair of breast cups to a lower edge of the cradle.

7. The brasserie of claim 1, wherein each breast cup in the pair of breast cups comprises an outer liner on an outer face of the foam pad, wherein a lower edge of the outer liner of each breast cup is not attached to the foam frame of the cradle other than by way of the inner liner.

8. The brasserie of claim 1, wherein the foam frame comprises an inner layer of foam and an outer layer of foam, and wherein the pair of curved support members are embedded between the inner and outer layers of foam.

9. The brassiere of claim 1, wherein the inner liner is made of a fabric that has a lower elastic modulus than that of the foam pads of the pair of breast cups.

10. A brassiere comprising:

a chest band configured to encircle and lay against a wearer's ribcage, the chest band comprising a foam frame including a pair of concavities, each concavity in the pair of concavities configured to be located below one of a wearer's breasts when the brassiere is worn; and a pair of breast cups, each breast cup being situated within a respective concavity in the pair of concavities, and each breast cup comprising a foam pad;

an inner liner attached to an inner face of each of the foam pads;

wherein the inner liner extends past a lower edge of the foam pad of each breast cup, and a lower portion of the inner liner is overlapped with the foam frame; and wherein a majority of the lower edge of the foam pad of each breast cup is not attached to the foam frame other than by way of the inner liner.

11. The brassiere of claim 10, wherein the chest band further comprises a pair of wings, each wing in the pair of wings being coupled to a respective lateral side edge of the foam frame; and wherein the brassiere further comprises an outer layer extending over the foam frame, the pair of breast cups, and the pair of wings and forming an outer face of the brassiere.

12. The brassiere of claim 11, wherein each wing in the pair of wings comprises an intermediate layer and an inner liner adjacent an inner face of the intermediate layer; and wherein the outer layer is bonded to an outer face of the intermediate layer of each wing.

13. The brassiere of claim 12, wherein the intermediate layer of each wing is a self-bonding panel.

14. The brassiere of claim 13, wherein the self-bonding panel is a polymer mesh.

15. The brassiere of claim 12, wherein the outer layer is not bonded to an outer face of either of the breast cups in the pair of breast cups.

16. The brassiere of claim 10, wherein the inner liner is one continuous piece of fabric that covers the inner face of each of the foam pads and extends to a lower edge of the foam frame.

17. The brasserie of claim 10, wherein each breast cup in the pair of breast cups comprises an outer liner on an outer face of the foam pad, wherein a lower edge of the outer liner of each breast cup is not attached to the foam frame other than by way of the inner liner.

18. The brasserie of claim 10, wherein the foam frame comprises an inner layer of foam and an outer layer of foam, and the brassiere further comprises a pair of curved support members embedded between the inner and outer layers of foam.

19. The brassiere of claim 10, wherein the inner liner is made of a fabric that has a lower elastic modulus than that of the foam pads of the pair of breast cups.

* * * * *